US005562068A

United States Patent [19]

Sugimoto et al.

[11] Patent Number: 5,562,068

[45] Date of Patent: Oct. 8, 1996

[54] COMPRESSION RATIO CHANGING DEVICE IN INTERNAL COMBUSTION ENGINE

[75] Inventors: Mitsuru Sugimoto; Iwao Kadota; Takashi Moriya, all of Saitama, Japan

[73] Assignee: Honda Giken Kogyo Kabushiki Kaisha, Tokyo, Japan

[21] Appl. No.: 477,848

[22] Filed: Jun. 7, 1995

[30] Foreign Application Priority Data

Jul. 13, 1994 [JP] Japan ..... 6-161544

[51] Int. Cl.[6] ..... F02D 15/02; F02B 75/04

[52] U.S. Cl. ..... 123/48 B; 123/78 E; 123/197.4; 123/78 BA

[58] Field of Search ..... 123/48 B, 78 BA, 123/78 E, 78 F, 197.3, 197.4

[56] References Cited

U.S. PATENT DOCUMENTS

| | | | |
|---|---|---|---|
| 4,254,743 | 3/1981 | Reid et al. | 123/48 B |
| 4,450,797 | 5/1984 | Moser | 123/197.4 |
| 4,687,348 | 8/1987 | Naruoka et al. | 123/48 B |

FOREIGN PATENT DOCUMENTS

| | | | |
|---|---|---|---|
| 0038343 | 3/1983 | Japan | 123/78 E |
| 62-121837 | 6/1987 | Japan . | |
| 3092552 | 4/1991 | Japan | 123/78 E |

*Primary Examiner*—Marguerite Macy
*Attorney, Agent, or Firm*—Lyon & Lyon

[57] ABSTRACT

A compression ratio changing arrangement in an internal combustion engine. In order to change the compression ratio by utilizing, to the maximum, an eccentric amount between inner and outer peripheral surfaces of an eccentric ring interposed between a crank pin and a large end of a connecting rod in a compression ratio changing device, the eccentric ring is selectively connected to the crank pin or the large end of the connecting rod by a connecting pin with the thinnest portion or thickest portion of the connecting ring being turned toward the center of rotation of a crankshaft. The selective connection is performed when the piston is at botton dead center. When the eccentric ring has been connected to the crank pin, the stroke of the piston is increased or decreased by an amount corresponding to two times the eccentric amount of the eccentric ring without changing the position of the bottom dead center of the piston, as compared to the stroke with when the eccentric ring has been connected to the large end.

8 Claims, 8 Drawing Sheets

Top dead center (High compression ratio operational state)
Middle point

Bottom dead center
LL=2r+2ε
A
2
2B
3
4
6
9
1P
O
r
ε

(Low compression ratio operational state)
Top dead center
Middle point
Bottom dead center
Ls=2r
A
2B
6
2
3
4
9
1P
O
ε

COMPRESSION RATIO CHANGING DEVICE IN INTERNAL COMBUSTION ENGINE

BACKGROUND OF THE INVENTION

1. Field of the Invention

The present invention relates to a compression ratio changing device in an internal combustion engine for changing the compression ratio between two stages, i.e., low and high stages in which a connecting rod connected at its smaller end to a piston is carried at its large end on a crank pin of a crank-shaft, and particularly, to an improvement in a compression ratio changing device of a type including an eccentric ring which is interposed between the crank pin and the large end of the connecting rod and whose inner and outer peripheral surfaces are eccentric from each other.

2. Description of the Prior Art

Such type of the compression ratio changing device is already known, as disclosed, for example, in Japanese Patent Application Laid-open No. 121837/87.

The following devices are disclosed in the Japanese Patent Application Laid-open No. 121837/87: (1) a device in which the eccentric ring is connected to the large end of the connecting rod, so that the eccentric direction of the eccentric ring can be switched between opposite directions, and (2) a device in which the eccentric ring is connected to the crank pin, so that the eccentric direction of the eccentric ring can be switched between opposite directions. In the device (1), the stroke of the piston is not changed, but the position of top and bottom dead centers of the piston are only changed, by switching the eccentric direction of the eccentric ring, and therefore, the compression ratio is changed only to a small extent. In the device (2), the stroke of the piston is increased or decreased by switching the eccentric direction of the eccentric ring, but in a high compression ratio state with an increased stroke of the piston, the position of the bottom dead center of the piston is lowered and for this reason, the compression ratio cannot be sufficiently increased. Therefore, in either of the devices (1) and (2), if a large change in compression ratio is desired, an eccentric ring having a large eccentric amount is required and hence, an increase in size of the engine is imposed.

SUMMARY OF THE INVENTION

Accordingly, it is an object of the present invention to provide a compression ratio changing device in an internal combustion engine, wherein the compression ratio can be effectively changed without causing an increase in size of the engine, by utilizing the eccentric amount of the eccentric ring to the maximum.

To achieve the above object, according to the present invention, there is provided a compression ratio changing device in an internal combustion engine in which a connecting rod connected at its smaller end thereof to a piston is carried at its large end on a crank pin of a crankshaft, the compression ratio changing device comprising, an eccentric ring having an inner and outer peripheral surfaces which are eccentric from each other by a predetermined amount and which are rotatably fitted to an outer peripheral surface of the crank pin and an inner peripheral surface of the large end of the connecting rod, respectively, the eccentric ring being provided with a connection switchover means capable of selectively establishing a first connected state in which the eccentric ring is connected to the crank pin with the eccentric direction of the inner and outer peripheral surfaces being turned toward the center of rotation of the crankshaft, and a second connected state in which the eccentric ring is connected to the large end, such that it assumes the same position as in the first connected state at a bottom dead center of the piston.

With the above feature, the piston stroke can be increased or decreased by an amount corresponding to two times the eccentric amount between the inner and outer peripheral surfaces without changing the bottom dead center position of the piston. Therefore, it is possible to effectively change the compression ratio by utilizing the eccentric amount to the maximum, and to suppress the eccentric amount to a necessary minimum to avoid an increase in size of the engine.

The above and other objects, features and advantages of the invention will become apparent from preferred embodiments taken in conjunction with the accompanying drawings.

DESCRIPTION OF THE PREFERRED EMBODIMENTS

The present invention will now be described by way of preferred embodiments taken in conjunction with the accompanying drawings.

Figure 1:
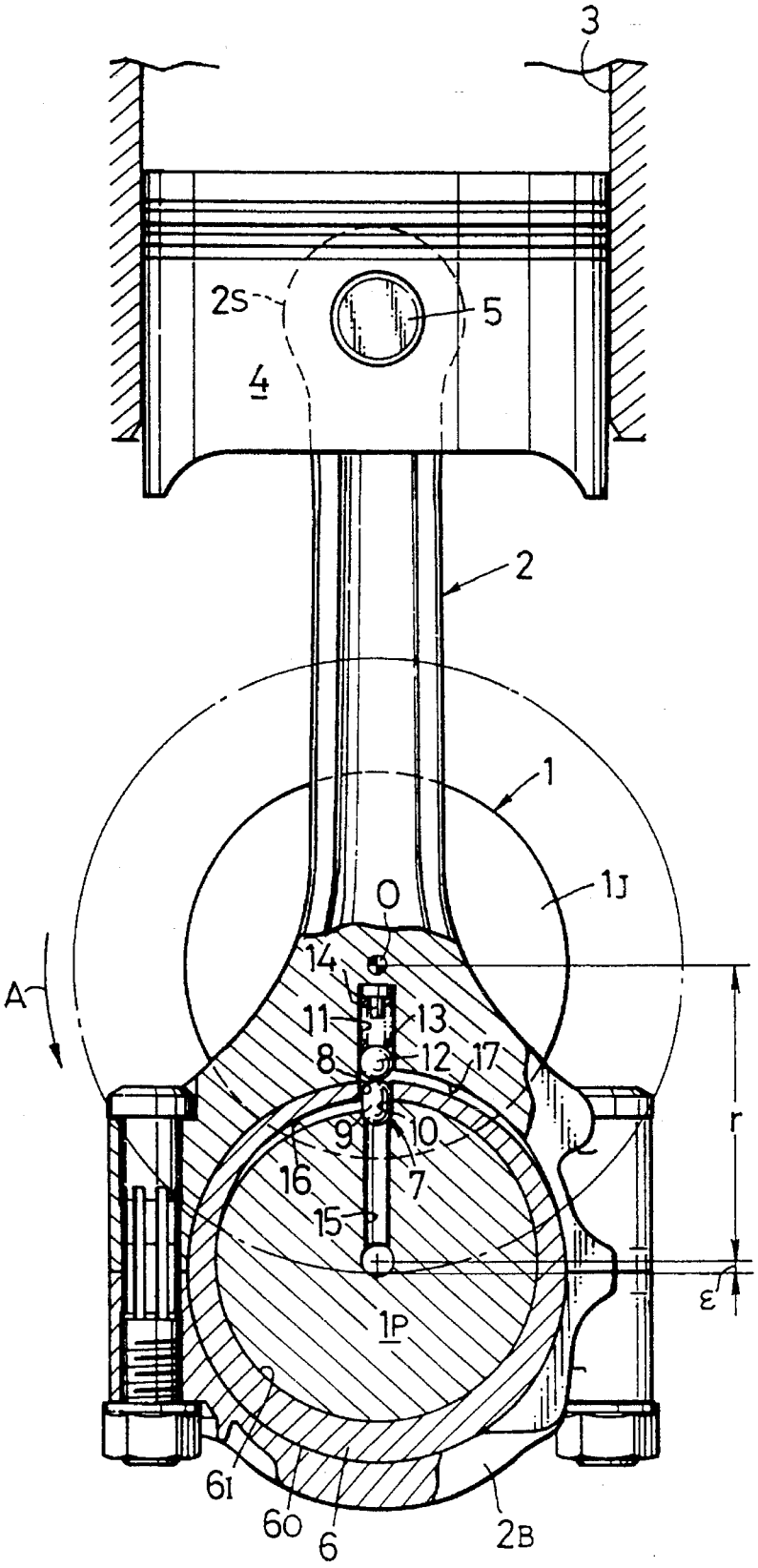
FIG. 1 is a cross-sectional view of a portion of an internal combustion engine having a compression ratio changing device according to a first embodiment of the present invention in a high compression ratio operational state of the engine.
Figure 2:
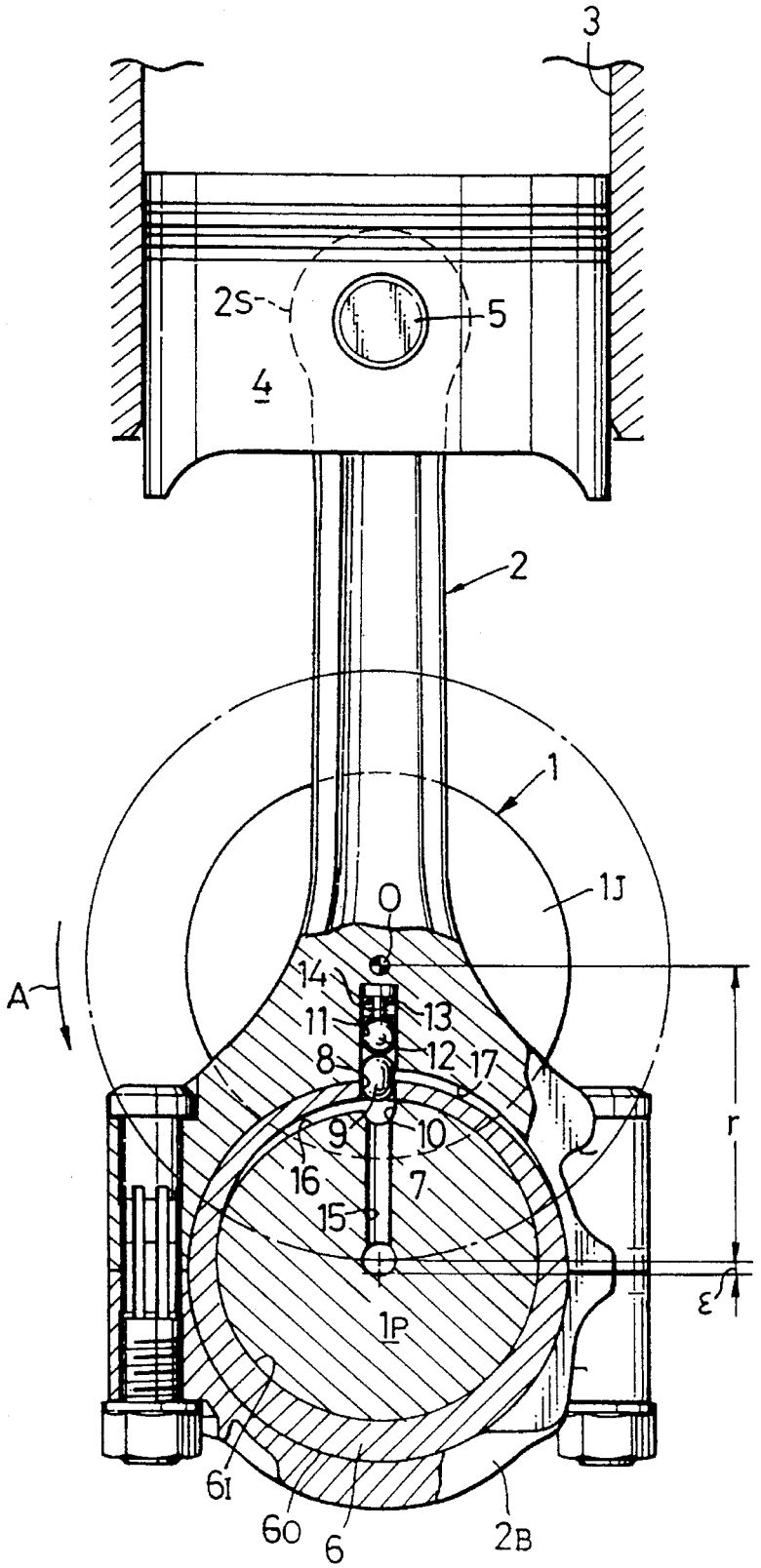
FIG. 2 is a cross-sectional view of the engine in a low compression ratio operational state thereof.

A first embodiment of the present invention shown in FIGS. 1 to 5 will be first described. Referring to FIGS. 1 and 2, a crankshaft 1 of an internal combustion engine includes a crank journal $\mathbf{1}_J$ carried on a bearing portion of a crankcase, and a crank pin $\mathbf{1}_P$ integrally connected to an end of the crank journal $\mathbf{1}_J$. A large end $\mathbf{2}_B$ of a connecting rod 2 is carried by the crank pin $\mathbf{1}_P$, and a piston 4 slidable in a cylinder bore 3 in a cylinder block is connected to a smaller end $\mathbf{2}_S$ of the connecting rod 2 through a piston pin 5.

An eccentric ring 6 is fitted between the large end $\mathbf{2}_B$ of the connecting rod 2 and the crank pin $\mathbf{1}_P$, and has an inner peripheral surface $\mathbf{6}_I$ rotatably fitted over an outer peripheral surface of the crank pin $1_P$, and an outer peripheral surface $6_O$ relatively rotatably fitted to an inner peripheral surface of the large end $2_B$. The inner and outer peripheral surfaces $6_I$ and $6_O$ are offset through a given distance $\epsilon$ from each other.

The eccentric ring 6 is provided with a connection switchover means 7 for controlling the eccentric ring 6 to a first connected state (a state shown in FIG. 1) in which it has been connected to the crank pin $1_P$ and a second connected state (a state shown in FIG. 2) in which it has been connected to the large end $2_B$ of the connecting rod 2. The connection switchover means 7 will be described below in detail.

A radial pin hole 8 is provided in the thinnest portion of the eccentric ring 6, i.e., a portion at which the inner and outer peripheral surfaces $6_I$ and $6_O$ are closest to each other, and a connecting pin 9 longer than the pin hole 8 is slidably received in the pin hole 8. The outer peripheral surface of the crank pin $1_P$ and the inner peripheral surface of the large end $2_B$ are provided with first and second connecting holes 10 and 11, respectively, into and from which inner and outer ends of the connecting pin 9 can be fitted and disengaged. Accommodated in the second connecting hole 11 in the large end $2_B$ are a ball 12, a return spring 13 for biasing the ball 12 toward the eccentric ring 6, and a stopper 14 for defining the largest depth of ingress of the ball 12 into the second connecting hole 11.

The length of the connecting pin 9, the depths of the first and second connecting holes 10 and 11 and the length of the stopper 14 are set, such that when the connecting pin 9 has been reliably fitted into the first connecting hole 10, the outer end of the connecting pin 9 is disengaged and removed from the second connecting hole 11 to provide the first connected state, and when the connecting pin 9 has been reliably fitted and engaged into the second connecting hole 11 until it pushes the ball 12 against the stopper 14, the inner end of the connecting pin 9 is disengaged from the first connecting hole 10 to provide the second connected state.

An oil passage 15 is provided in the crank pin $1_P$ and opens at its downstream end into a bottom of the first connecting hole 10. A hydraulic pressure supply source (not shown) such as a hydraulic pump is connected to an upstream portion of the oil passage 15 and is capable of supplying a working hydraulic pressure to the oil passage 15 at a proper time. When the working hydraulic pressure has been supplied to the oil passage 15, it urges the connecting pin 9 radially outwardly.

A first guide groove 16 is provided in the outer peripheral surface of the crank pin $1_P$, so that the inner end of the connecting pin 9 can be slid in the first guide groove 16 through approximately 90° from the first connecting hole 10 in a direction of rotation of the crank pin $1_P$ about its axis. The depth of the groove is gradually increased from zero toward the first connecting hole 10. A second guide groove 17 is provided in the inner peripheral surface of the large end $2_B$, so that the outer end of the connecting pin 9 can be slid through approximately 90° from the second connecting hole 11 in a direction opposite to the direction of rotation of the crank pin $1_P$ about its axis. The depth of the second guide groove is gradually increased from zero toward the second connecting hole 11.

In the drawings, an arrow A indicates the direction of rotation of the crankshaft 1, and a character O indicates the center of rotation of the crankshaft 1.

The operation of the first embodiment will be described below.

Figures 3A, 3B, 3C:
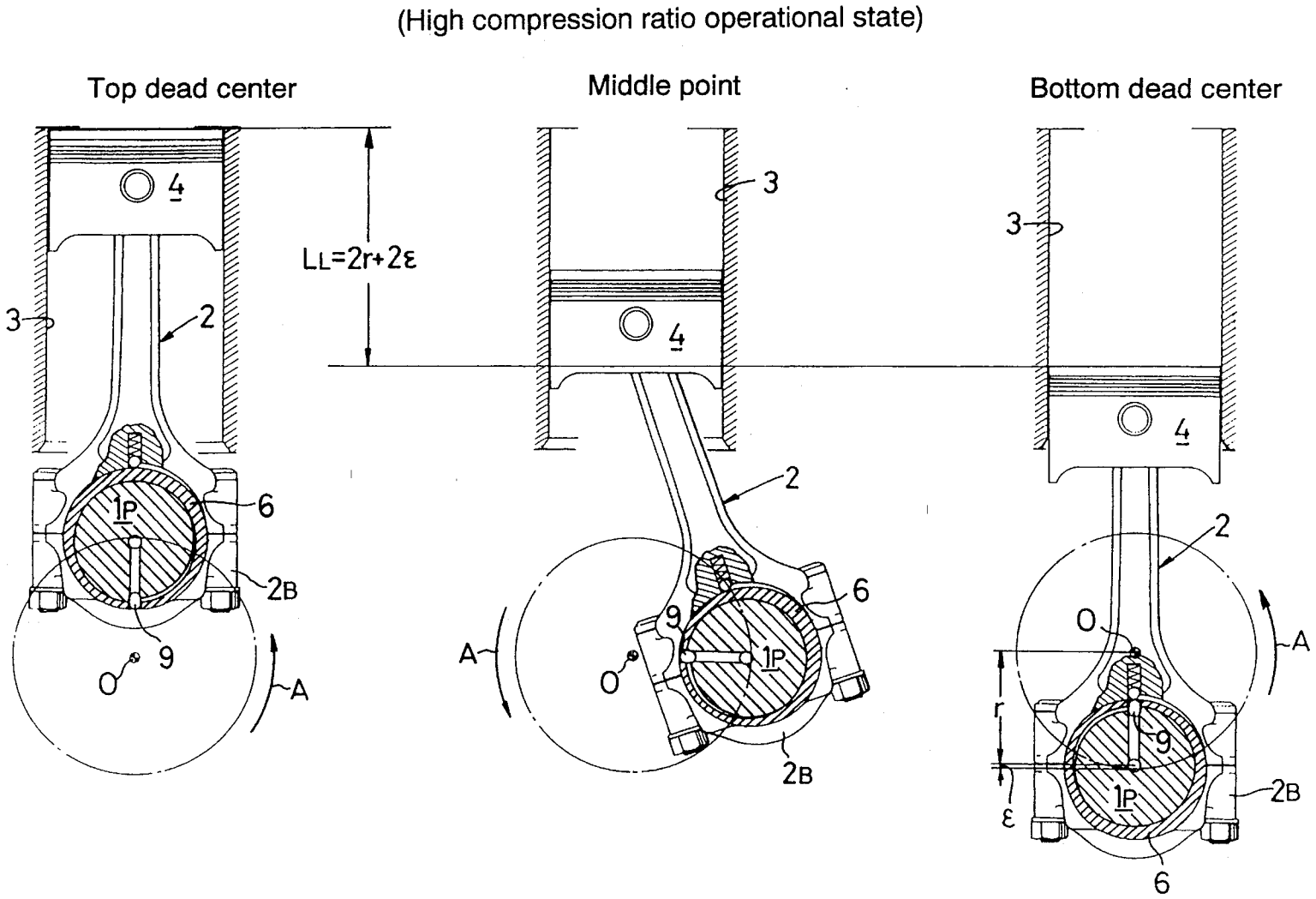
FIG. 3*a*–3*c* are views of the engine in three positions for explaining the operation in the high compression ratio operational state of the engine.

Assuming that the working hydraulic pressure has been released at the upstream portion of the oil passage 15, the connecting pin 9 is fitted into the first connecting hole 10 by a resilient force of the return spring 13 to provide the first connected state, as shown in FIG. 1. Thus, the eccentric ring 6 is connected to the crank pin $1_P$ with its thinnest portion turned toward the center of rotation of the crankshaft 1. As a result, the eccentric ring 6 is rotated about the center O of the crankshaft 1 in unison with the crank pin $1_P$ with the rotation of the crankshaft 1, as shown in FIG. 3*a*, 3*b* and 3*c* thereby providing the circular motion to the large end $2_B$ of the connecting rod 2 to lift and lower the piston 4. This is a high compression ratio operational state, and the stroke $L_L$ of the piston 4 in this operational state can be represented by the following expression:

$$L_L=2\times r+2\times\epsilon \quad (1)$$

wherein r is a radius of revolution of the crank pin $1_P$ about the center O; and $\epsilon$ is an eccentric amount between the inner and outer peripheral surfaces $6_I$ and $6_O$ of the eccentric ring 6.

If the working hydraulic pressure is supplied to the oil passage 15 when in such high compression ratio operational state, the hydraulic pressure is applied to the inner end of the connecting pin 9 to urge the connecting pin 9 radially outwardly. While the connecting pin 9 is not in alignment with the second connecting hole 11, the connecting pin 9 is rotated together with the crank pin $1_P$ and the eccentric ring 6 with an outer end of the connecting pin 9 is sliding contact with the inner peripheral surface of the large end $2_B$. But as soon as the connecting pin 9 is aligned with the second connecting hole 11 (at this time, the piston 4 reaches a bottom dead center), it is fitted into the second connecting hole 11 while forcing the ball 12 further into hole 11 by the hydraulic pressure against the resilient force of the return spring 13, and at the same time, the connection pin 9 is disengaged and removed from the first connecting hole 10, thereby causing the eccentric ring 6 to be brought into the second connected state. In this case, the connecting pin 9 is brought into engagement with the second guide groove 17 from a position of approximately 90° short of the second connecting hole 11, whereby it is guided into the second connecting hole 11 and hence, the switching operation of the connecting pin 9 is smoothly performed.

Figures 4A, 4B, 4C:
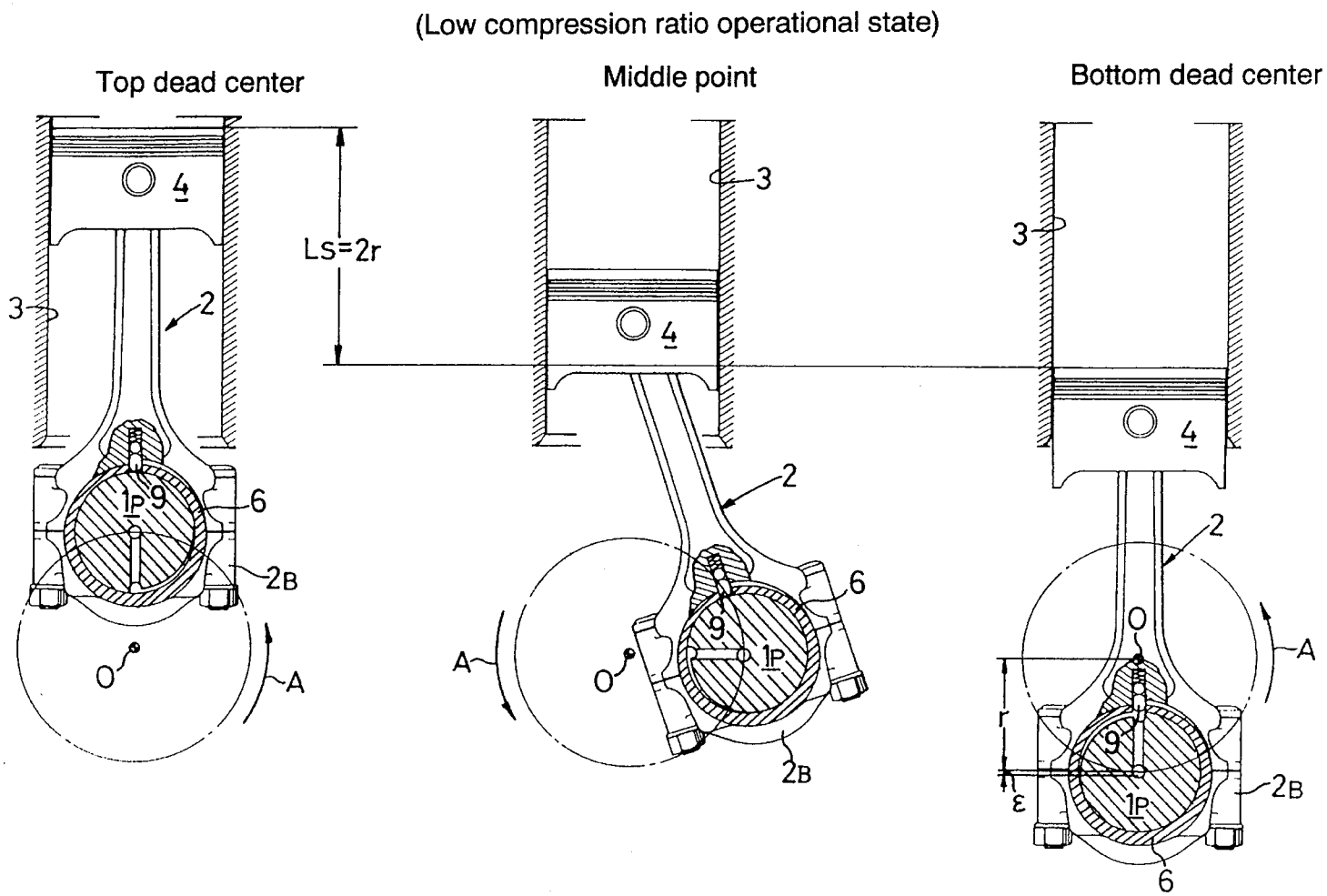
FIG. 4*a*–4*c* are views of the engine in three positions for explaining the operation in the low compression ratio operational state of the engine.

In the second connected state of the eccentric ring 6, the eccentric ring 6 is connected to the large end $2_B$ with the thinnest portion thereof turned toward the smaller end $2_S$ of the connecting rod 2 and hence, the crank pin $1_P$ provides a circular motion to the eccentric ring 6 and the large end $2_B$ with the rotation of the crankshaft 1 to lift and lower the piston 4. This is a low compression ratio operational state as shown in FIGS. 4*a*, 4*b* and 4*c*, and the stroke $L_S$ of the piston 4 in this operational state can be represented by the following expression:

$$L_S=2\times r \quad (2)$$

wherein r is a radius of revolution of the crank pin $1_P$ about the center O.

As can be seen from the foregoing, in either of the high and low compression ratio operational states, the connecting pin 9 is located on a straight line connecting the center O of rotation of the crankshaft 1 and the center of the crank pin $1_P$, when the piston 4 is at the bottom dead center. Therefore, the direction of the eccentric ring 6 is not changed and hence, the position of the bottom dead center of the piston 4 is always constant. Moreover, according to the above expressions (1) and (2), the stroke $L_L$ of the piston 4 in the high compression operational state is increased by an amount two times the eccentric amount e between the inner and outer peripheral surfaces of the eccentric ring 6, as compared with that in the low compression ratio operational state, and hence, the eccentric amount is utilized to the maximum for an increase in compression ratio.

If the hydraulic pressure in the oil passage 15 is released during the low compression ratio operational state, the inner end of the connecting pin 9 is biased radially inwardly by the resilient force of the return spring 13 and is in sliding contact with the outer peripheral surface of the crank pin $\mathbf{1}_P$, while the connecting pin 9 is not aligned with the first connecting hole 10. However, the connecting pin 9 is engaged with the first guide groove 16 from the position of 90° short of the first connecting hole 10, whereby it is guided into the first connecting hole 10. Thus, when the connecting pin 9 becomes aligned with the first connecting hole 10 (even at this time, the piston 4 reaches the bottom dead center), it can be smoothly fitted into the first connecting hole 10. This restarts the high compression ratio operational state.

Figure 5:
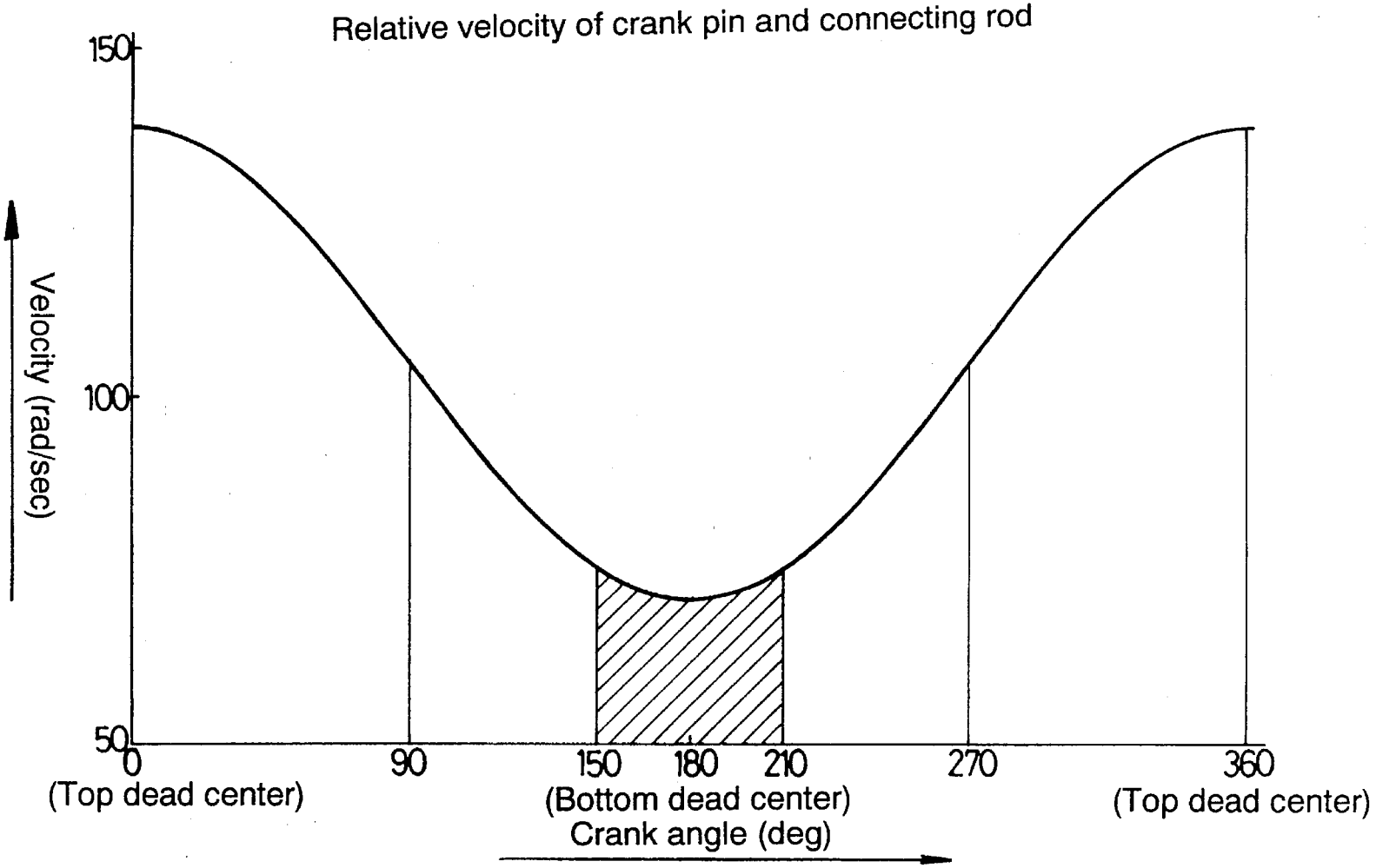
FIG. 5 is a diagram illustrating the relationship between the crank angle and the relative velocity of a crank pin and a large end of a connecting rod, as well as the best switching timing for a connection pin.

FIG. 5 illustrates the relationship between the angle of rotation of the crankshaft 1 and the relative velocity of the crank pin $\mathbf{1}_P$ and the large end $\mathbf{2}_B$ of the connecting rod 2. As can be seen from FIG. 5, the relative velocity of the crank pin $\mathbf{1}_P$ and the large end $\mathbf{2}_B$ is smallest in a range of plus or minus 30° from the bottom dead center. Therefore, if the positions of the first and second connecting holes 10 and 11 are established, such that the connecting pin 9 is aligned with the first and second connecting holes 10 and 11 in this range, it is possible to maximize the time available for the switchcover shifting of the connecting pin 9 between the first and second connecting holes 10 and 11, thereby accurately performing the switchover shifting of the connecting pin 9.

In this case, by providing the second connecting hole 11 in a rod portion of the large end $\mathbf{2}_B$ of the connecting rod $\mathbf{2}_B$, a sufficient depth of the second connecting hole 11 is achieved, thereby facilitating the placement of the stopper 14, the return spring 13 and the ball 12.

Figure 6:
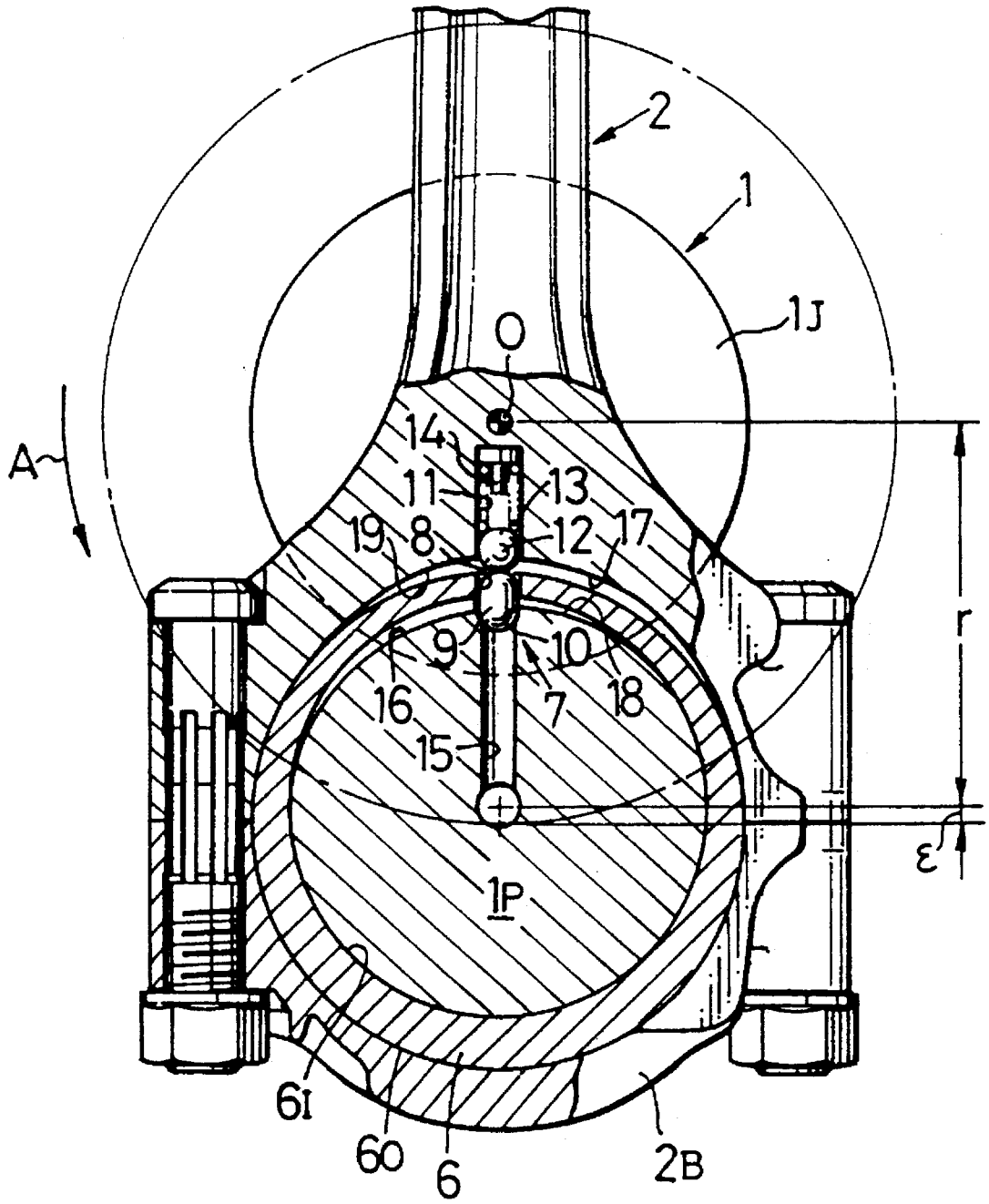
FIG. 6 is a cross-sectional view of an internal combustion engine having a compression ratio changing device according to a second embodiment of the present invention.

FIG. 6 illustrates a second embodiment of the present invention. Referring to FIG. 6, a first escape groove 18 is provided in the outer peripheral surface of the crank pin $\mathbf{1}_P$ to extend from the first connecting hole 10 over a range of approximately 45° in a direction opposite from the first guide groove 16, and has its depth gradually decreased in such direction. A second escape groove 19 is provided in the inner peripheral surface of the large end $\mathbf{2}_B$ to extend from the second connecting hole 11 over a range of approximately 45° in a direction opposite from the second guide groove 17, and has its depth gradually decreased in such direction. The other features and constructions are the same as in the previous embodiment and hence, portions or components corresponding to those in the previous embodiment are designated by like reference characters in FIG. 6 and will not be described again.

In this embodiment, when the connecting pin 9 is shifted into the first connecting hole 10 or the second connecting hole 11, the inner or outer end of the connecting pin 9 can be engaged into the first or second escape groove 18 or 19 only by slight displacement of the connecting pin 9. Therefore, the disengagement of the connecting pin 9 from the first or second connecting hole 10 or 11 can be performed quickly, thereby preventing a disadvantage that the inner and outer ends of the connecting pin 9 are simultaneously fitted into the first and second connecting holes 10 and 11.

Figure 7:
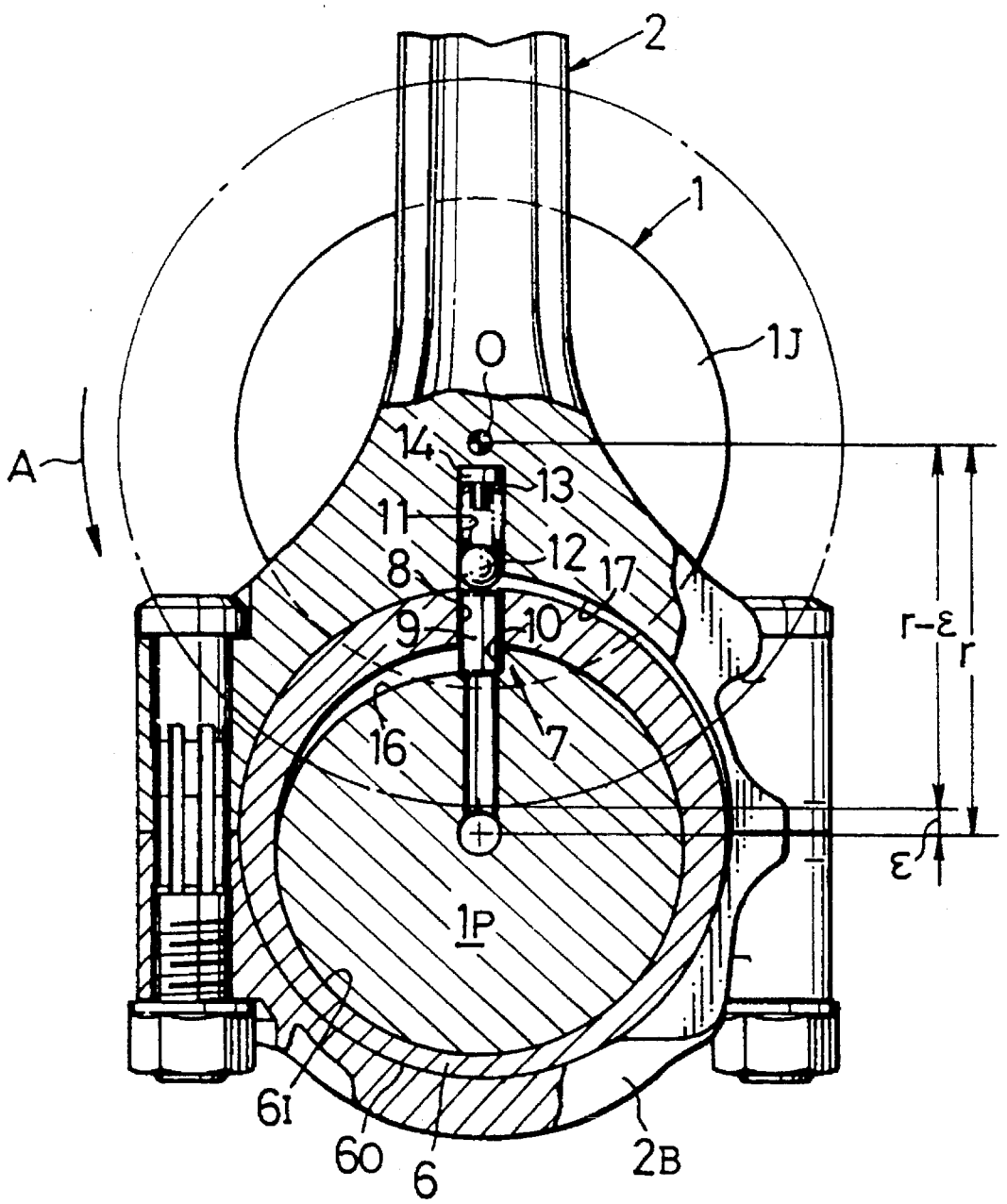
FIG. 7 is a cross-sectional view of an internal combustion engine having a compression ratio changing device according to a third embodiment of the present invention.

FIG. 7 illustrates a third embodiment of the present invention, in which the low compression ratio operational state is achieved by the first connected state in which the eccentric ring 6 has been connected to the crank pin $\mathbf{1}_P$, and the high compression ratio operational state is achieved by the second connected state in which the eccentric ring 6 has been connected to the large end $\mathbf{2}_B$ of the connecting rod. The third embodiment is of a structure similar to that of the first embodiment, except that the thickest portion of the eccentric ring 6 is provided with a pin hole 8 through which the connecting pin 9 is slidably passed. Therefore, portions or components corresponding to those in the first embodiment are designated by like reference characters in FIG. 7.

In the third embodiment, the stroke $L_s$ of the piston 4 provided when the connecting pin 9 has been fitted into the first connecting hole 10 to connect the eccentric ring 6 to the crank pin $\mathbf{1}_P$ (in the low compression ratio operational state) can be represented by the following expression (3):

$$L_S=2r-2\epsilon \tag{3}$$

wherein r is a radius of revolution of the crank pin $\mathbf{1}_P$ about the center O, and $\epsilon$ is an eccentric amount between the inner and outer peripheral surfaces $\mathbf{6}_I$ and $\mathbf{6}_o$ of the eccentric ring 6.

The stroke $L_L$ Of the piston 4 provided when the connecting pin 9 has been fitted into the second connecting hole 11 to connect the eccentric ring 6 to the large end $\mathbf{2}_B$ (in the high compression ratio operational state) can be represented by the following expression (4):

$$L_L=2r \tag{4}$$

Even in this embodiment, the direction of the eccentric ring 6 is not changed at the bottom dead center of the piston 4 in the high and low compression ratio operational states and hence, the position of the bottom dead center of the piston 4 is stationary. Therefore, as can be seen from the expressions (3) and (4), the eccentric amount ⊢â of the eccentric ring 6 contributes a maximum amount to a decrease in compression ratio.

Moreover, since the pin hole 8 for supporting the connecting pin 9 is provided in the thickest portion of the eccentric ring 6, a sufficient supporting length for the connecting pin 9 can be insured to prevent the inclination of the connecting pin 9 to the utmost.

Further, the low compression ratio operational state is achieved by fitting of the connecting pin 9 into the first connecting hole 10 under the action of the resilient force of the return spring and hence, if a trouble is generated in the hydraulic system to cause the hydraulic pressure in the oil passage 15 to be lost in the high compression ratio operational state in which the connecting pin 9 has been fitted into the second connecting hole 11, the connecting pin 9 will become fitted into the first connecting hole 10 by the resilient force of the return spring 13, so that the operational state is automatically returned to the low compression ratio operational state, thereby insuring a fail-safe condition.

Figure 8:
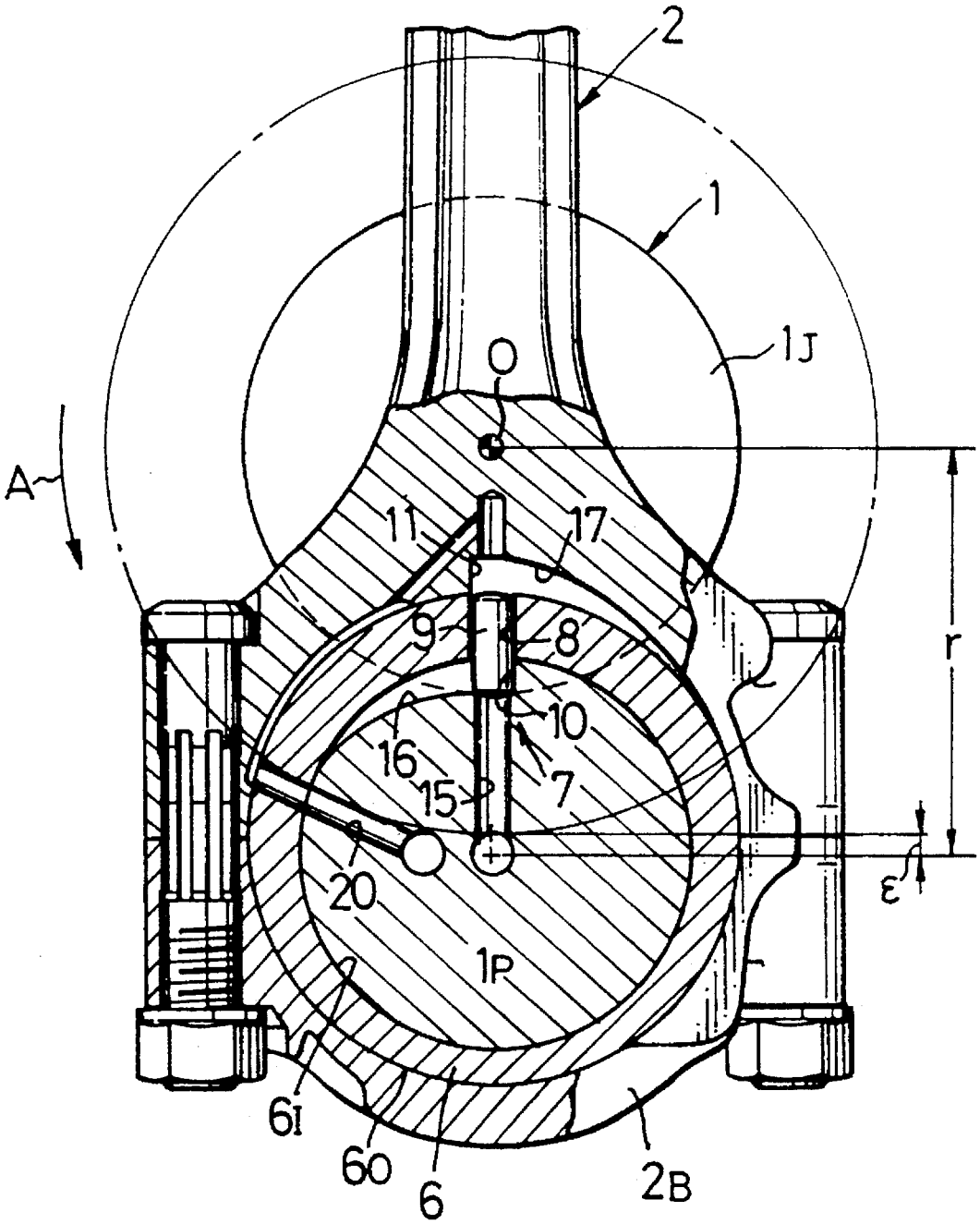
FIG. 8 is a cross-sectional view of an internal combustion engine having a compression ratio changing device according to a fourth embodiment of the present invention.

FIG. 8 illustrates a fourth embodiment of the present invention, in which the entire switching operation is performed by hydraulic pressure.

More specifically, the depth of each of the first and second connecting holes 10 and 11 is set at a value equal to the stroke of the connecting pin 9, and in place of the ball 12 and the return spring 13 in the previous embodiments, a second oil passage 20 is provided and opens at its downstream end into the bottom surface of the second connecting hole 11. The depths of deepest portions of the first and second guide grooves 16 and 17 are set at values equal to those of the corresponding first and second connecting holes 10 and 11. An upstream portion of the second oil passage 20 extends through the crankshaft 1 as does the first oil passage 15, so that a working hydraulic pressure may be supplied from a hydraulic pressure supply source to the second oil passage 20 at a proper time. The other arrangements are the same as in the third embodiment and hence, portions or components corresponding to those in the third embodiment are designated by like reference characters in FIG. 8.

If a working hydraulic pressure is supplied selectively into the second oil passage 20 or the first oil passage 15, the connecting pin 9 can be fitted into the first connecting hole 10 or into the second connecting hole 11 by reception of such hydraulic pressure, thereby connecting the eccentric ring 6 to the crank pin $\mathbf{1}_P$ or the large end $\mathbf{2}_B$ of the connecting rod. Since the depths of the deepest portions of the first and second guide grooves 16 and 17 are set at values equal to those of the corresponding first and second connecting holes 10 and 11, the switchability of fitting the connecting pin 9 between the first and second connecting holes 10 and 11 is further enhanced.

Although the embodiments of the present invention have been described in detail, it will be understood that the present invention is not limited to the above-described embodiments, and various modifications in design may be made without departing from the spirit and scope of the invention defined in claims.

For example, in consideration of the mountability of the eccentric ring 6 to the crank pin $\mathbf{1}_P$, the eccentric ring 6 may be constructed so that it is diametrically splittable into two parts.

What is claimed is:

1. A compression ratio changing device in an internal combustion engine in which a connecting rod has a smaller end connected to a piston and a large end carried on a crank pin of a crankshaft, said compression ratio changing device comprising, an eccentric ring having inner and outer peripheral surfaces which are eccentric from each other by a predetermined amount and which are rotatably fitted to an outer peripheral surface of the crank pin and an inner peripheral surface of the large end of the connecting rod, respectively, said eccentric ring being provided with a connection switchover means capable of selectively establishing a first connected state in which said eccentric ring is connected to said crank pin with the eccentric direction of said inner and outer peripheral surfaces being turned toward the center of rotation of said crankshaft, and a second connected state in which said eccentric ring is connected to said large end, said eccentric ring having the same position in said first and second connected states at a bottom dead center of said piston.

2. A compression ratio changing device in an internal combustion engine according to claim 1, wherein said connection switchover means comprises: a radial pin hole provided in said eccentric ring; a connecting pin slidably fitted into said pin hole; first and second connecting holes into which inner and outer ends of said connecting pin are alternately fitted, said first and second connecting holes being provided in the outer peripheral surface of the crank pin and the inner peripheral surface of the large end of the connecting rod, respectively; a first push means for pushing said connecting pin out of said first connecting hole and fitting it into said second connecting hole; and a second push means for pushing said connecting pin out of said second connecting hole and fitting it into said first connecting hole.

3. A compression ratio changing device in an internal combustion engine according to claim 2, wherein said first push means includes an oil passage through which a hydraulic pressure for pushing said connecting pin out of said first connecting hole can be introduced into said first connecting hole, and said second push means includes a return spring accommodated in said second connecting hole to bias the connecting pin so as to push the connecting pin out of said second connecting hole.

4. A compression ratio changing device in an internal combustion engine according to claim 3, wherein said second connecting hole has a ball accommodated therein for transmitting the biasing force of said return spring to said connecting pin.

5. A compression ratio changing device in an internal combustion engine according to claim 2, wherein said crank pin has a first guide groove provided in its outer peripheral surface to extend arcuately in a direction of rotation of said crank pin about its axis for the inner end of the connecting pin to slide in the first guide groove, the first guide groove having a depth gradually increased from zero toward said first connecting hole.

6. A compression ratio changing device in an internal combustion engine according to claim 5, wherein the large end of said connecting rod has a second guide groove provided in its inner peripheral surface to extend arcuately from the second connecting hole in a direction opposite to the direction of rotation of said crank pin about its axis for the outer end of the connecting pin to slide in the second guide groove, said second guide groove having a depth gradually increased from zero toward said second connecting hole.

7. A compression ratio changing device in an internal combustion engine according to claim 2, wherein said first push means includes a first oil passage through which a hydraulic pressure for pushing said connecting pin out of said first connecting hole can be introduced into said first connecting hole, and said second push means includes a second oil passage through which a hydraulic pressure for pushing said connecting pin out of said second connecting hole can be introduced into said second connecting hole.

8. A compression ratio changing device in an internal combustion engine according to any of claims 2 to 7, wherein the switchover shifting of said connecting pin between said first and second connecting holes is performed in a crank angle range of plus or minus 30° from the bottom dead center of said crank pin.

* * * * *